US010194252B2

(12) United States Patent
Kaplan

(10) Patent No.: US 10,194,252 B2
(45) Date of Patent: Jan. 29, 2019

(54) HEARING AID DEVICE

(71) Applicant: BETTER HEARING S.A.A.K. TECHNOLOGIES LTD, Or Akiva (IL)

(72) Inventor: Shay Kaplan, Givat Elah (IL)

(73) Assignee: BETTER HEARING S.A.A.K. TECHNOLOGIES LTD., Or Akiva (IL)

( * ) Notice: Subject to any disclaimer, the term of this patent is extended or adjusted under 35 U.S.C. 154(b) by 347 days.

(21) Appl. No.: 14/422,154

(22) PCT Filed: Aug. 20, 2013

(86) PCT No.: PCT/IL2013/050704
§ 371 (c)(1),
(2) Date: Feb. 17, 2015

(87) PCT Pub. No.: WO2014/030159
PCT Pub. Date: Feb. 27, 2014

(65) Prior Publication Data

US 2015/0230034 A1 Aug. 13, 2015

Related U.S. Application Data

(60) Provisional application No. 61/684,818, filed on Aug. 20, 2012.

(51) Int. Cl.
*H04R 25/00* (2006.01)
*H04R 17/00* (2006.01)

(52) U.S. Cl.
CPC ..... *H04R 25/48* (2013.01); *H04R 25/60* (2013.01); *H04R 25/606* (2013.01); *H04R 17/00* (2013.01); *H04R 2225/67* (2013.01)

(58) Field of Classification Search
CPC ..... H04R 25/00–25/75
See application file for complete search history.

(56) References Cited

U.S. PATENT DOCUMENTS 5,701,378 A 12/1997 Shennib et al.
5,772,575 A 6/1998 Lesiniski et al.
(Continued)

FOREIGN PATENT DOCUMENTS

CN 1176731 A 3/1998
CN 1732712 A 2/2006
(Continued)

OTHER PUBLICATIONS

International Search Report from International Application No. PCT/IL2013/050704 dated Nov. 18, 2013.

*Primary Examiner* — Thaddeus B Cox
(74) *Attorney, Agent, or Firm* — Dorsey & Whitney LLP

(57) ABSTRACT

A hearing aid device is presented being configured for direct cochlea vibration stimulation. The hearing aid device comprises: a deformable member configured for contracting and expanding along a deformation axis between its first and second sides in response to an applied external field; and a fastening assembly configured for carrying the deformable member so as to provide rigid coupling of the first and second sides of the deformable member to a bony tissue in the vicinity of cochlea, such that contraction and expansion of said deformable member directly stimulates vibration of the cochlea.

11 Claims, 8 Drawing Sheets

(56) References Cited

U.S. PATENT DOCUMENTS

| | | | | |
|---|---|---|---|---|
| 7,618,450 | B2 | 11/2009 | Zarowski et al. | |
| 2001/0031996 | A1 | 10/2001 | Leysieffer | |
| 2002/0035309 | A1 | 3/2002 | Leysieffer | |
| 2005/0020873 | A1* | 1/2005 | Berrang | H04R 25/606 600/25 |
| 2006/0161255 | A1 | 7/2006 | Zarowski et al. | |
| 2009/0240099 | A1* | 9/2009 | Conn | A61N 1/0541 600/25 |
| 2011/0152603 | A1* | 6/2011 | Perkins | H04R 25/606 600/25 |
| 2011/0295053 | A1 | 12/2011 | Ball | |
| 2012/0253104 | A1* | 10/2012 | Andersson | H04R 17/00 600/25 |
| 2013/0261377 | A1* | 10/2013 | Adamson | H04R 25/606 600/25 |

FOREIGN PATENT DOCUMENTS

| | | |
|---|---|---|
| JP | 11506572 | 6/1999 |
| WO | WO9621335 | 7/1996 |
| WO | WO09/065971 | 5/2009 |

* cited by examiner (GENERAL ART)

(GENERAL ART)

HEARING AID DEVICE

TECHNOLOGICAL FIELD

The present invention is generally in the field of listening devices such as hearing aids, and relates to a hearing aid device for improving hearing efficiency through cochlea vibratory stimulation.

BACKGROUND

Cochlear implants are used to provide individuals suffering from sensorineural hearing loss with the ability to perceive sound. Cochlear implant electrically stimulates the auditory nerve via an electrode array implanted in the cochlea to induce a hearing percept in the prosthesis recipient. Acoustic hearing aids are used by individuals suffering from conductive hearing loss occurring when normal mechanical pathways conducting sound to hair cells or the hair cells in the cochlea are impeded.

Generally, a listening device, such as a hearing aid or the like, includes a microphone assembly, an amplifier and a transducer assembly. The microphone assembly receives acoustic pressure waves, and generates an electronic signal representative of these sound waves. The amplified and possibly modified (processed) electronic signal is communicated to the transducer assembly. The transducer assembly, in turn, converts the processed electronic signal into acoustic energy for transmission to a user. Other types of hearing aids use implantable electrode devices that directly stimulate the nerves. Yet another type of listening devices includes bone conduction speakers to transmit the converted vibrations to the cochlea. Other versions of such devices are based on vibration of one or more of the auditory ossicles.

Lately, some devices have been described of the type that directly vibrate the promontorium or even the fluid inside the cochlea. Devices utilizing direct vibration of the promontorium include an electromagnetic vibrator that is attached to the bone, while devices utilizing direct vibration of the fluid inside the cochlea require drilling of a hole in the promontorium. Such techniques are described for example in U.S. Pat. No. 7,618,450. This patent discloses an implantable hearing system comprising a vibration actuator and an implantable device to be used as an artificial fenestrum implantable in a bony wall of an inner ear. The device comprises a frame made of a bio-compatible material and provided to be applied at least partially in said bony wall, the frame being provided with a wall part formed by a membrane forming a barrier with a perilymph of said inner ear when applied in said bony wall. The membrane is provided to form together with the frame an interface with the inner ear, said interface being provided for energy transfer towards and from said inner ear, while the membrane is electrically dissociated from the vibration actuator and provided for receiving vibration energy therefrom.

GENERAL DESCRIPTION

There is a need in the art in a novel approach for the configuration and operation of hearing aid devices that improves the efficiency and frequency span of the direct cochlea vibration.

The cochlea is the auditory portion of the inner ear. It is a spiral-shaped cavity in the bony labyrinth, in humans making 2.75 turns around the modiolus (a conical shaped central axis in the cochlea). In this connection, reference is made to FIG. 1 showing the components of an ear. The cochlea is a portion of the inner ear that receives sound in the form of vibrations, which cause the stereocilia to move. The stereocilia then convert these vibrations into nerve impulses which are transferred up to the brain to be interpreted. The promontory of the tympanic cavity, called cochlear promontory, is a rounded hollow prominence, formed by the projection outward of the first turn of the cochlea.

As indicated above, hearing devices have been proposed that are based on directly vibrating the promontorium or fluid inside the cochlea, or vibration of one or more of the auditory ossicles. However, such devices, while being capable of vibrating one or more of the auditory ossicles, cannot produce enough vibration power to help people with very bad hearing. A device that directly vibrates the promontorium is typically attached to the promontorium, and accordingly most of the vibration energy is lost to the air on the other side of the device. As for the known devices that vibrate the cochlear fluid directly, they are capable of applying the vibrations only to the small area of the device opening and suffer from low efficiency especially at high frequencies.

According to the present invention, a novel technique is provided that improves the efficiency of direct cochlea vibration. The invention utilizes a device comprising a deformable member which is entirely rigidly coupled to a bony tissue and deforms (contracts and expands) in response to an external applied field (e.g. electric signal), thereby directly transferring the vibration energy to a predetermined portion of said bony tissue, as will be described further below. Attachment of such a deformable member to a bony tissue of the cochlea, or, generally, in the vicinity of the cochlea, enables direct transfer of a deformation profile (time function) of the deformable member to corresponding vibrations of the cochlea. The deformable member is rigidly coupled to the cochlea's bony tissue by a fastening assembly, which is configured for rigid coupling to two distant regions of the bony tissue.

In some embodiments, the fastening assembly is configured to be anchored rigidly to a portion of the cochlea (e.g. promontorium or any other part of the cochlea) by its one side and by its opposite side to be rigidly connected to either another distant portion of the cochlea or any other bone structure in the vicinity of the cochlea. Such bone structure may be an attic bone, which is located in attic or epitympanic recess; or other bone in the skull.

As the deformable member of the device expands or contracts (in response to electric stimulus, e.g. the voltage waveform received from an amplifier), the entire movement/deformation of the device is transferred to the bones at both sides of the device, where the bone with the lesser mass and more compliance, that of the promontorium, moves a larger distance, than the other bone, when being pushed by the device deformation.

It should be understood that the term promontorium used herein actually refers to any other part of the inner ear capsule. It should also be noted that the term "vicinity of the cochlea" used herein actually refers to any bony tissue in the vicinity of the cochlea, whether being the inner ear capsule or other bony tissue, around the middle ear.

It should be understood, that the device of the present invention is configured for attaching the deformable member at its both ends (along the axis of deformation) to the bony tissue of the cochlea, and therefore is capable of applying very high forces to the bony tissue and causing a direct vibration of the cochlea. It should also be noted, that the technique of the present invention does not need any impedance matching and has no low pass effects (like those of bone conduction or air conduction). The device of the present invention can be operated at frequencies from a few Hertz up to the ultrasonic frequency range of 16 kHz and higher.

Thus, according to one aspect of the invention, there is provided a hearing aid device comprising: a deformable member configured for contracting and expanding along a deformation axis between its first and second sides in response to an applied external field; and a fastening assembly configured for carrying the deformable member to provide rigid coupling of the first and second sides of the deformable member to a bony tissue in the vicinity of cochlea, such that contraction and expansion of said deformable member directly stimulates vibration of the cochlea.

In some embodiments, the fastening assembly is configured for rigidly coupling the deformable member to first and second distant portions of the bony tissue in the vicinity of cochlea, such that the contraction and expansion of the deformable member forces a movement of at least one of the first and second distant portions towards and away from the other.

For example, the fastening assembly may comprise first and second fasteners, where the first fastener comprising an anchoring unit associated with a first side of the deformable member, and the second fastener is associated with a second opposite side of the deformable member. In this configuration, the axis of the contraction and expansion of the deformable member (deformation axis) connects the first and second sides thereof.

The second fastener may comprise a bio-compatible attachment material composition. The configuration may be such that the anchoring unit has first and second opposite ends and is configured for rigid coupling by its first end to the first side of the deformable member and rigid coupling by its second end to the first portion of the bony tissue, while the second fastener comprises a mating unit having first and second opposite sides and being configured for rigid coupling by its first side to the second side of the deformable member and rigid coupling by its second side to the second portion of the bony tissue.

In some embodiments of the invention, the first fastener is configured for rigid coupling to the first portion of the bony tissue being a first portion of the cochlea, e.g. promontorium portion of the cochlea, and the second fastener is configured for coupling to the second portion of the bony tissue being a second portion of the cochlea.

In some embodiments of the invention, the first fastener is configured for coupling to the first portion of the bony tissue being a portion of the cochlea, e.g. promontorium portion of the cochlea, and the second fastener is configured for coupling the second portion of the bony tissue being a portion of an attic bone.

In some embodiments, the configuration is such that the fastening assembly comprises a rigid member having first and second integral end portions configured for rigid coupling to the first and second portions of the bony tissue of the cochlea and an intermediate portion defining a recess for accommodating the deformable member therein, while the deformable member is by its first side connected to the intermediate portion, such that when the rigid member with the deformable member attached thereto is installed in place, the deformable member by its opposite second side interacts with a cochlea region between said first and second portions thereof, and deforms along an axis connecting the first and second sides thereof. It should be understood that in this case, the recess is preferably much larger than the size of the deformable member, to thereby increasing efficiency of the vibration transfer to the cochlea.

Preferably, the deformable member comprises a piezoelectric structure responding to the applied field. It should be understood that the term piezoelectric element or structure used herein also refers to a piezoelectric stack or any other device that can deform in response to an applied field.

According to another broad aspect of the invention, there is provided a hearing aid device comprising:

a deformable member having first and second opposite sides and configured for contracting and expanding along an axis thereof connecting the first and second opposite sides thereof in response to an applied external field; and a fastening assembly configured for rigidly anchoring said deformable member by its first and second sides to respectively first and second distant portions of bony tissue in the vicinity of cochlea;

a deformation profile of the deformable member while deforming along said axis in response to a profile of the applied field thereby causing a corresponding movement of the fastening assembly resulting in direct vibrations of the cochlea.

According to yet further aspect of the invention, there is provided a hearing aid device comprising:

a deformable member having first and second opposite sides and configured for contracting and expanding along an axis thereof connecting the first and second opposite sides thereof in response to an applied external field; and a fastening assembly comprising a rigid bridge-like member having first and second end portions configured for rigid coupling to the first and second portions of the bony tissue of the cochlea, and an intermediate portion defining a recess for accommodating the deformable member being connected to said intermediate portion, the device, when installed in place, thereby providing direct contact of the deformable member by its opposite second side with a cochlea region between said first and second portions thereof, a deformation profile of the deformable member along said axis in response to a profile of the applied field thereby directly causing corresponding vibrations of the cochlea.

The present invention, in its yet further aspect, provides a system for improving hearing efficiency of an individual. The system comprises an implantable hearing device comprising at least the hearing aid device configured as described above for direct cochlea vibration stimulation; and an electronic system for receiving sound signals and transmitting corresponding actuating signals to the deformable member to thereby cause a deformation profile of the deformable member indicative of the received sound signals.

As described above, the device of the invention includes the fastening assembly which at least by one end thereof may be anchored to the bony tissue. The anchoring may be achieved by using screws to attach the fastening assembly (e.g. the bridge-like member) to the portion of cochlea, e.g. the promontorium of the cochlea.

As also indicated above, the deformable member may include a piezoelectric structure. The latter may be configured as a piezoelectric stack (e.g. 2×2×2 mm in size) that expands and contracts in response to an electrical signal, e.g. model PL022.31 commercially available from PI, Germany. Such piezoelectric structure responds to voltage by expanding or contracting in a value proportional to the voltage on its terminals.

The anchoring and/or mating structures/units that can be used for anchoring one or more sides of the fastening assembly to the bony tissue can also be configured for adjusting a gap between the portion of the device attached to the bony tissue and the tissue to requirements for different patients.

In some embodiments of the current invention, the mating structure may include a plate-like element having a substantially planar side by which the element can be bonded to the deformable member, and having an opposite surfaces formed with one or more pins or sharp-edge protrusions that can eliminate or at least significantly reduce lateral movement of the device when pressed against a bone structure.

In some other embodiments, the mating structure may include a plate like element having a substantially planar side by which the element can be bonded to the deformable member, having the other side curved with a curvature similar to that of the target location on the promontorium so as to assist in bonding the mating structure to the promontorium using a bio-compatible attachment (cement or similar compounds). It should be noted, that whenever the rigid bonding using bio-compatible cement is used, the rigidity of the material used can be adjusted as to ensure long term safety of the anchored device.

In some embodiments, a shallow niche can be carved in the promontorium in the target location, and the device can be directly bonded to said niche.

In some embodiments of the current invention, the anchoring structure may be an elongated member having a screw shape portion on one side that may be screwed into the bone, and a head portion on the other side having an outer surface designed to be coupled or bonded to the deformable member. The screw may also have a through hole perpendicular to the screw axis for installation of a tool assisting in screwing the anchoring structure into the bone and adjusting how much it protrudes from the surface as to match the different distances in different patients or locations.

In some embodiments, the deformable member is attached to the promontorium using a low profile means involving cement with or without use of a mating structure, and a screw type structure is used on the bone at the opposite side.

In some embodiments, the system of the invention is configured for directly and efficiently vibrating the cochlea, in conjunction with using direct nerve stimulation (cochlear implant) to cover the low frequency range.

In some embodiments of the current invention, the required electrical signals are fed by wires to drive the device.

Since the device of the invention is very efficient, it may be easily driven by an implantable unit that receives both power and data using wireless transmission techniques as known in the art.

Since the device of the invention provides direct transfer of the deformation profile (corresponding to the input sound) to the cochlea vibrations, the signal transfer function is almost perfectly linear, and accordingly the microphone input does not have to be converted into a digital signal, processed and then fed into the device. A microphone, preferably placed in the ear canal, can be connected to a simple amplifier that may be used to amplify the microphone signal, compress it into the dynamic range (appropriately fitted to the required range for person who is to use the device), and deliver the output signal to a wireless transmitter, to be transmitted to the device of the invention, or directly wire fed to the deformable member.

In some embodiments, the wireless unit may have an over voltage protection using voltage limiting circuit in order to assure that in case of an error, the device would not be capable of vibrating with an amplitude that would cause the user to hear very strong sounds.

In some embodiments, an external microphone is used, preferably placed in the ear canal, and is connected to a processing unit that processes the signal to reach the required dynamic range, spectral adjustment etc., and also converts parts of the spectrum to signals driving the cochlea vibrating device and some parts of the spectrum to a cochlear implanted electrode.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1:
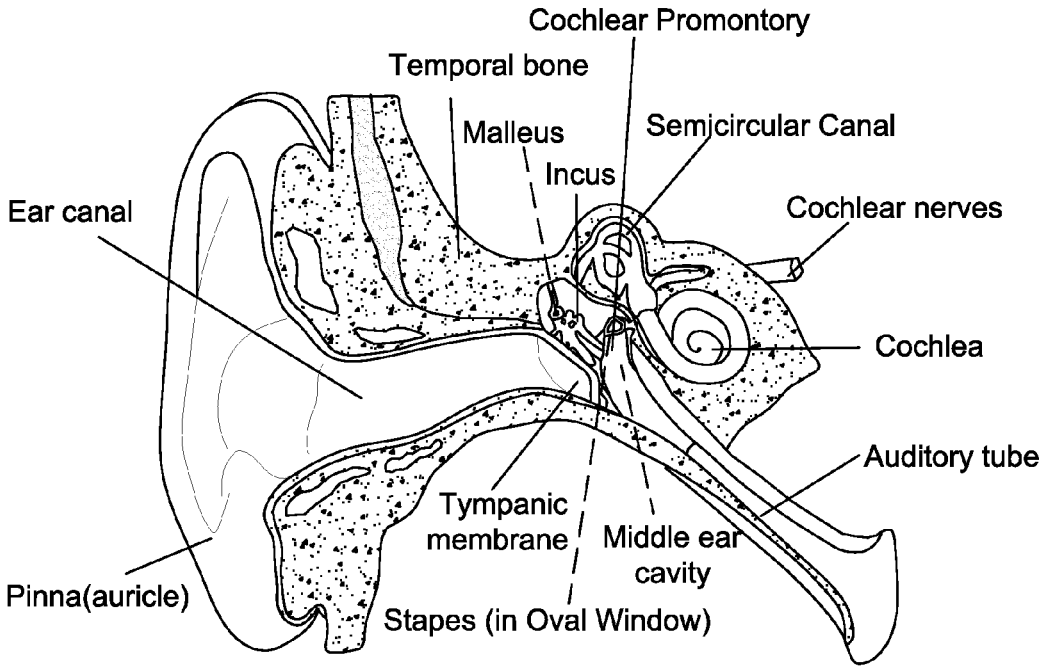
FIG. 1 is a schematic representation of an ear.

FIG. 1 shows a schematic representation of the ear, showing a region of bony tissue in the vicinity of cochlea. As will be exemplified further below, the hearing aid of the present invention is configured for attachment to the bony tissue in the vicinity of cochlea so as to directly vibrate the cochlea.

Figure 2A:
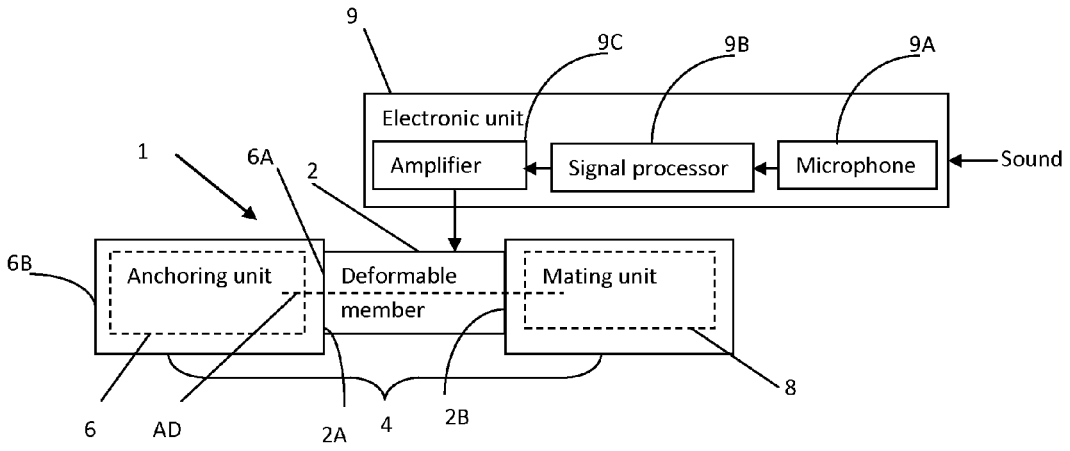
FIGS. 2A and 2B schematically illustrate configurations of a device of the present invention in two embodiments thereof, respectively.
Figure 2B:
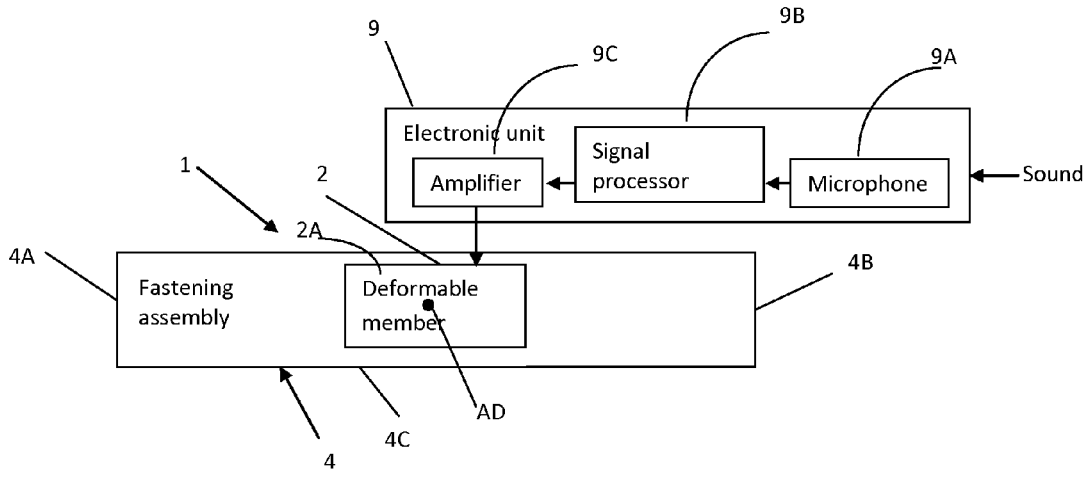

Reference is made to FIGS. 2A and 2B showing, by way of a block diagram, two examples of the configuration of a hearing aid device, generally designated 1, of the present invention. To facilitate illustration and understanding, the same reference numbers are used for identifying components that are common in all the examples of the invention.

The device 1 includes a deformable member 2 and a fastening assembly 4 that carries the deformable member 2, e.g. the deformable member is attached to the fastening assembly. The deformable member 2 is configured for changing its dimension, i.e. contracting and expanding, in response to an applied external field, e.g. electric field. Typically, the deformable member 2 is configured as or includes a piezoelectric element/structure. The piezoelectric element/structure may be of any suitable configuration; such elements are known per se and therefore need not to be described in details. The fastening assembly 4 is configured for rigidly coupling to a bony tissue in the vicinity of cochlea.

The device of the present invention is connectable (via wires or wireless signal transmission) to an electronic system 9 which is configured and operable to convert input sound signals (signal profile) into corresponding profile/variations of a field (e.g. electric field/voltage) applied to the deformable member 2. As a result, contraction and expansion of said deformable member directly stimulate vibrations of the cochlea.

It should be understood, although not specifically shown, that the electronic system 9 may be formed by a single unit, or the functional elements of the electronic system may be distributed in separate units connected between them via wires or wireless signal transmission. For example, a microphone may be associated with an external part of the electronic system and is configured to be attachable to the ear, while some or all other components of the electronic system are associated with another, internal part located inside the middle ear. The electronic system 9 thus includes a microphone 9A that receives sound pressure waves and generates electric output indicative thereof; and an amplifier 9C. Preferably, the electronic system 9 also includes a signal processor 9B which may for example be configured (pre-programmed) for providing a desired spectral profile of the signal, e.g. may include an equalizer utility. The electronic system 9 may be configured for wire-based or wireless transmission of the electric field/signal to the deformable member 2 to cause the deformation profile thereof which, in turn, will cause the vibration of cochlea.

Generally, the fastening assembly 4 is configured for rigidly coupling the deformable member 2 to first and second distant portions of the bony tissue in the vicinity of cochlea.

In some embodiments, the contraction and expansion of the deformable member 2 will thus cause a movement of at least one of the first and second distant portions towards and away from the other presenting a vibration movement. As shown, in the example of FIG. 2A, such fastening assembly 4 includes two fastening units 6 and 8, where one of them (unit 6), being referred to at times as anchoring unit or anchoring fastener, is associated with a first side/facet 2A of the deformable member 2, and the other (unit 8), being referred to at times as a mating unit or mating fastener, is associated with a second opposite side/facet 2B of the deformable member 2.

More specifically, the anchoring unit 6 is by its first end 6A rigidly coupled to the facet 2A of the deformable member 2, and by second opposite end 6B is rigidly coupled to the respective portion of the bony tissue. The mating fastener 8 may also be configured with two opposites sides attached to respectively the facet 2B of the deformable member 2 and the respective portion of the bony tissue; or as will be exemplified below may be constituted by gluing structure for directly gluing/bonding the deformable member to the bony tissue. When the actuating field is being applied to the deformable member 2, it contracts and expands along a deformation axis AD connecting the first and second sides 2A and 2B of the deformable member, which in turn causes movement/displacement of the fastening assembly resulting in corresponding vibrations of the cochlea to which the fastening assembly is directly coupled.

In some other embodiments, as exemplified in FIG. 2B, the fastening assembly 4 includes an integral element which is by its opposite ends 4A and 4B connectable to the first and second portions of the bony tissue, which are first and second spaced-apart portions of the cochlea. The deformable member 2 is by its one side/facet 2A connected to an intermediate portion 4C of the integral element. As will be described below, the intermediate portion is curved (convex) forming a groove in which the deformable member is located, such that its outer side/facet (side 2B not seen in the view of FIG. 2B) is intended to contact the cochlea. As will be described more specifically further below, such integral element may be configured as a rigid bridge-like member configured for rigid coupling to the distant portions of the cochlea. Thus, when the device is installed in place (i.e. the member 4 is by its opposite ends 4A and 4B rigidly coupled to cochlea), its opposite second side directly contacts/interacts with a cochlea region between the first and second portions thereof. When the actuating field is being applied to the deformable member 2, it contracts and expands along a deformation axis AD (through the figure) connecting the first and second sides 2A and 2B of the deformable member thus directly causing corresponding vibrations of the cochlea.

Figure 3:
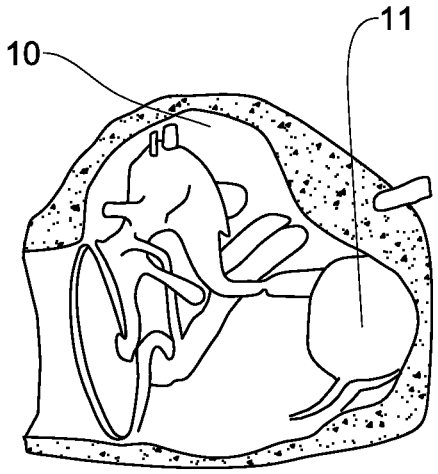
FIG. 3 illustrates a part of an inner ear where the device of the invention can be installed.
Figure 4:
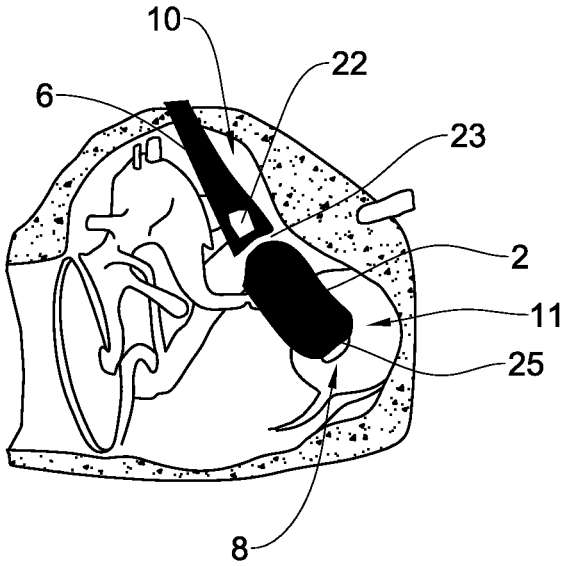
FIG. 4 exemplifies the device of the invention installed in the inner ear part illustrated in FIG. 3.

Referring now to FIGS. 3 and 4, there is exemplified how the device of the invention can be installed in the bony tissue in the vicinity of the cochlea, e.g. at the region of attic bone. FIG. 3 is a general illustration of such a region of the ear in the vicinity of cochlea. In this example, target surfaces for attachment of the device of the invention include a base surface (first portion of the bony tissue) 10 being constituted by the attic bone, and other target surface (second portion of the bony tissue) 11 being constituted by promontorium of the cochlea.

FIG. 4 schematically shows the ear portion of FIG. 3 together with the device of the invention attached to it. In this example, the device 10 is configured according to the embodiment of FIG. 2A, namely including a two-part fastening assembly, where the first part (anchoring unit) 6 is rigidly coupled to the deformable member at one side thereof and at the other side is connectable to the attic bone 10, while the second part (mating unit) 8 is rigidly coupled to the deformable member at the opposite side thereof and connectable to the promontorium 11. In this specific not limiting example, the fastening part 8 is constituted by bio-compatible cement 25 that directly bonds the deformable member 2 to the promontorium 11. On the other side, the deformable member is rigidly coupled to a screw type anchoring structure 6 also by cement 23. The screw is inserted into the attic bone, e.g. using a pin inserted into a hole 22 in the screw for rotating it, thus changing a length of the screw inserted into the bone which may also be used to adjust the device length to different patients ears. The promontorium bony issue is more compliant than the attic bone, and therefore, when the device is rigidly attached to both surfaces of the promontorium and of the attic bone, most of the translation of the device will cause the surface of the promontorium to vibrate/oscillate, and, in turn, the fluid inside the cochlea and the entire inner ear capsule will vibrate.

Figure 5A:
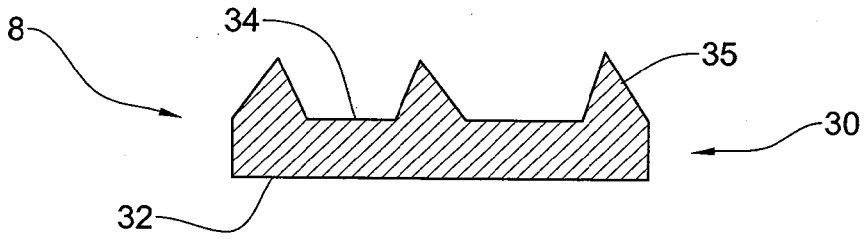
FIGS. 5A to 5D show several examples of the configuration of one of the fasteners of a fastening assembly suitable for use in the device of the invention.
Figure 5B:
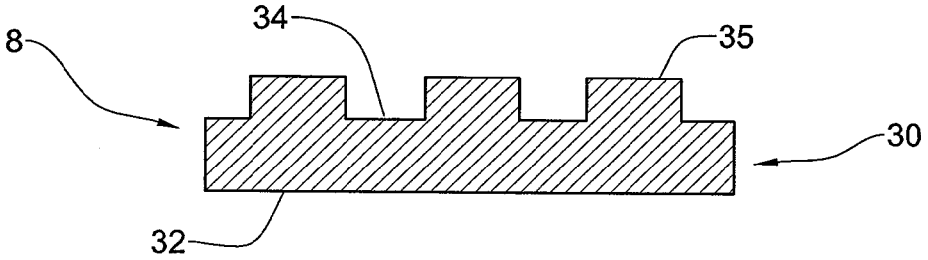
Figure 5C:
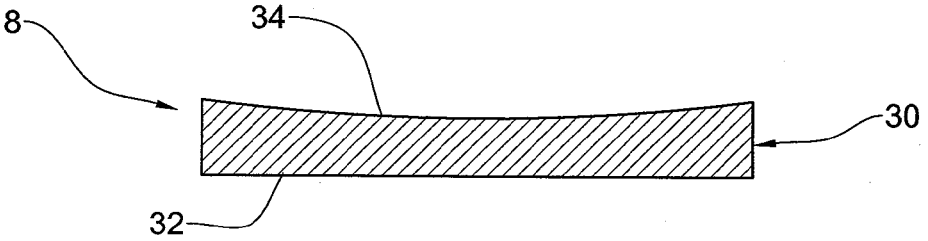

FIGS. 5A to 5C show some specific non-limiting examples of the configuration of a mating unit 8 which is attachable to the deformable member 2 and the curved surface of the bony tissue such as promontorium.

In these examples, the mating unit 8 is configured as a structure 30 having one flat surface 32 that can be bonded to the flat surface of the deformable member at the respective side thereof, and an opposite curved surface 34 by which the structure 30 is coupled to the bony tissue. In the examples of FIGS. 5A and 5B, the curved surface 34 has a pattern (surface relief) in the form of an array of spaced-apart protrusions 35. The surface with protrusions may be attached to the promontorium so as to prevent lateral movement of the fastening assembly on the promontorium's surface.

In the example of FIG. 5A, the protrusions have sharp tips that can be pushed into the surface of the promontorium or into a niche carved in it, with or without bonding cement in between. In the example of FIG. 5B, the protrusions 35 are in the form of pins (having substantially flat upper surface) instead of sharp protrusions. In this case, small shallow round cutouts may be made in the promontorium, for example using a stencil with holes in the correct locations. The mating surface (patterned surface) may then be attached or bonded to the promontorium.

In the example of FIG. 5C the mating structure 30 which is designed to be directly bonded by bio-compatible cement to the promontorium surface, has a curved surface 34 where in order to make the bonding stronger, curvature of the surface 34 matches that of the promontorium in the target region.

Figure 5D:
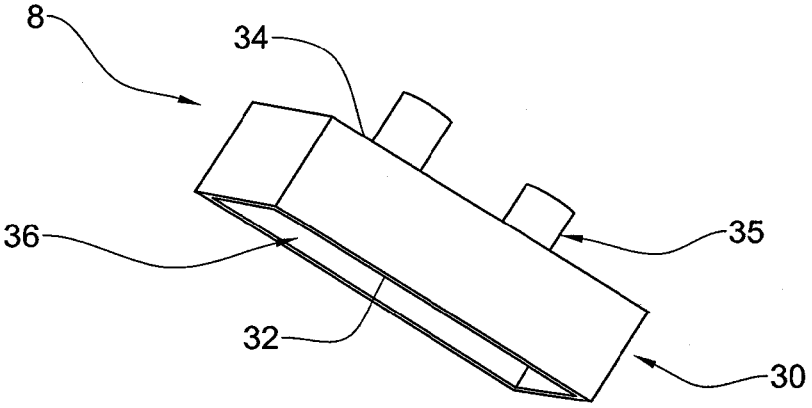

It should be appreciated that the opposite substantially planar surface 32 of any mating structure 30 may be machined to improve its attachment to the deformable member. For example, surface 32 may have a small cutout or recess (machined into it) so as to accept the respective side of the deformable member. This is exemplified in FIG. 5D. In this specific not-limiting example, the mating structure 30 having the curved surface with pins 35 (example of FIG. 5B) is illustrated, but it should be understood that the configuration of the mating unit is not limited to this specific example, as well as to any one of the above-described examples. As shown in the figure, the opposite surface 32 has a cutout 36 designed to accept the respective side of the deformable member.

Figure 6:
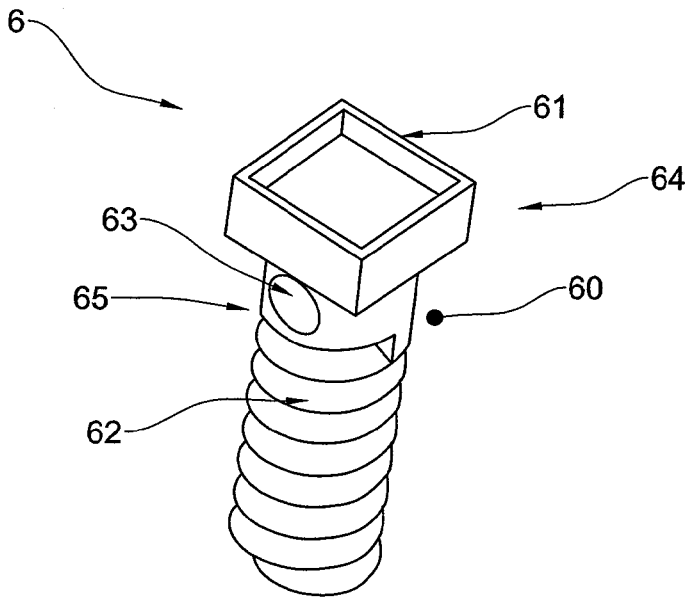
FIG. 6 exemplifies another fastener suitable to be used in the fastening assembly in the device of the invention.

Reference is made to FIG. 6 showing a schematic representation of an example of the configuration of an anchoring unit 6 by which the deformable member is coupled to the other bony tissue in the vicinity of the cochlea, e.g. to the attic bone. In this non-limiting example, the anchoring unit 6 has a screw type anchoring structure 60 for attachment to a bone.

More specifically, in this example, the anchoring structure 60 has a head portion 64 and a leg, screw portion 62 interconnected by an intermediate portion 65. The head portion 64 has a surface 61 (representing the end portion 6A in FIG. 2A) designed to be attached to the respective side of the deformable member. To this end, the surface 61 has a machined cutout that matches the shape of the respective side of the deformable member. The screw portion 62 (representing the end portion 6B in FIG. 2A) is configured for attachment to the bony tissue. The intermediate portion 65 has a connecting port (hole) 63 that may be used to accept a tool that can assist in turning the screw precisely in order to insert in into the bone and also adjust the length to the ear of the specific patient.

It should be noted that screw type anchoring units may be used for coupling to the promontorium bone and/or the opposite bone. In this case, the screw portion that should fit to the promontorium should be smaller, and preferably, not pass thought the wall into the ear fluid.

Figure 7:
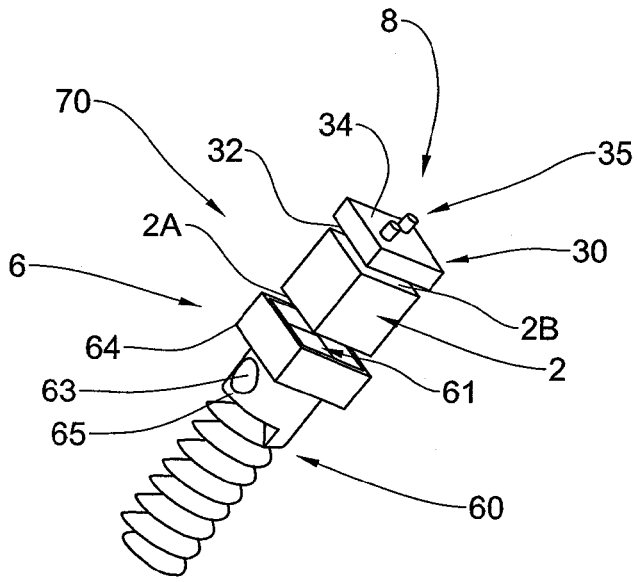
FIG. 7 shows an example of the device of the invention utilizing the fasteners of FIGS. 5D and 6.

FIG. 7 schematically illustrates a specific example of the construction of the hearing aid device 1 of the present invention for direct cochlea vibratory stimulation. For sake of clarity, the parts are shown offset from one another. In this non-limiting example, the fastening unit (mating unit) 8 has a pin type anchoring structure 30 (similar to that of FIG. 5B) having a patterned surface 34 with protrusions 35 for attachment to the bony tissue and has a planar surface 32 bonded to the deformable member 2 at facet 2B thereof. Further, in this non-limiting example, the fastening unit (anchoring unit) 6 is configured as that of FIG. 6 described above, namely has an anchoring structure 60, which by its head portion 64 (surface 61) carries the deformable member 3. Also, in this non-limiting example, the deformable member 2 is connected by wires to the electronic system (not shown) to receive the actuating signal/field.

In this specific example, the implant procedure may be as follows:

1. Bore shallow cutouts in the target region on the promontorium, for example by using a stencil in order to precisely locate the cutouts to match the locations of the pin protrusions 35.
2. Bond the mating structure 30 to the deformable member 2.
3. Screw the anchoring structure 60 into the bone on the opposite target surface on the promontorium. Insert it more than required so as to leave space for inserting the deformable member 2 and the mating unit attached thereto.
4. Bond the assembly to the promontorium surface while inserting pins 35 into the corresponding cutouts on the promontorium surface.
5. Apply bio-compatible cement to the free side of the deformable member 2.
6. Unscrew the anchoring structure 60 from the bone until the gap between it and the deformable member 2 is closed.
7. Attach the wires 70 to either external signal source or to a wireless driver circuit implanted in the middle ear.

Figure 8:
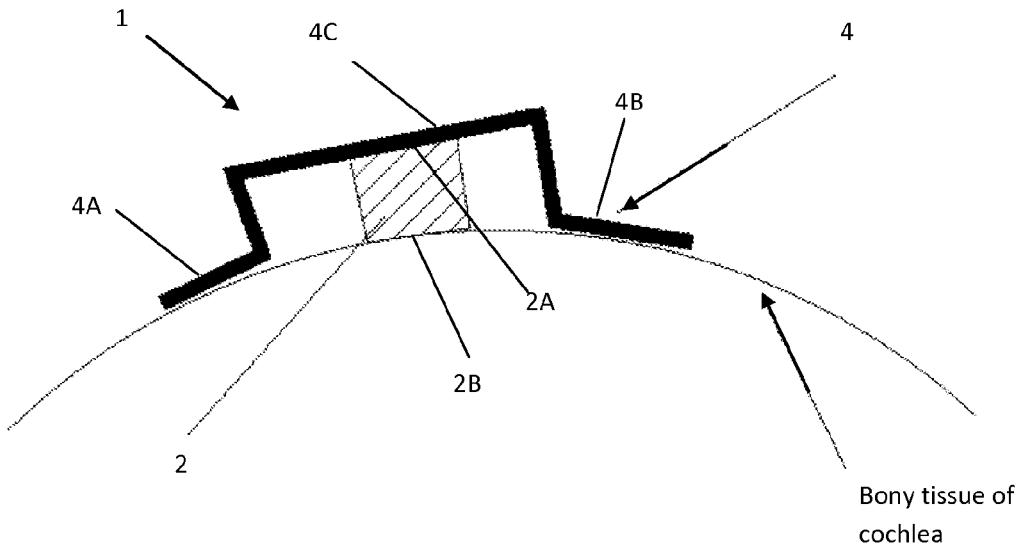
FIG. 8 shows another example of the device of the invention.

Reference is made to FIG. 8 showing a specific but not limiting example of the device 1 of the present invention configured and operable according to the embodiment of FIG. 2B, namely including a fastening assembly 4 having an integral element which is by its opposite ends 4A and 4B connectable to the first and second portions of the bony tissue, which may be first and second spaced-apart portions of the promontorium or another part of the cochlea. The deformable member 2 is by its one side/facet 2A connected to an intermediate curved portion 4C of the integral element. As shown, the element 4 is configured as a rigid (metallic) bridge-like member rigidly coupled to the distant portions of the promontorium or another part of the cochlea. For sake of simplicity, the screws that may be used for attaching the bridge to the bony tissue are not shown here. The intermediate portion 4C has a geometry forming a recess in which the deformable member 2 is located within a gap between the inner surface of the portion 4C and the cochlea. It should be noted that the recess is preferably much larger than the size of the deformable member, to thereby increase efficiency of the vibration transfer to the cochlea. The deformable member 2 by its one side/facet 2A is connected to the portion 4C and by its opposite side/facet 2B contacts the cochlea. When the actuating field is being applied to the deformable member 2, it expands and contracts towards and away from the cochlea thus directly causing corresponding vibrations of the cochlea.

It is preferable to manufacture all the metallic parts used in the device from non-magnetic metal(s), such as Titanium, so as to make it possible for a patient having this device installed to pass medical examinations that involve high magnetic fields such as MRI.

Figure 9A:
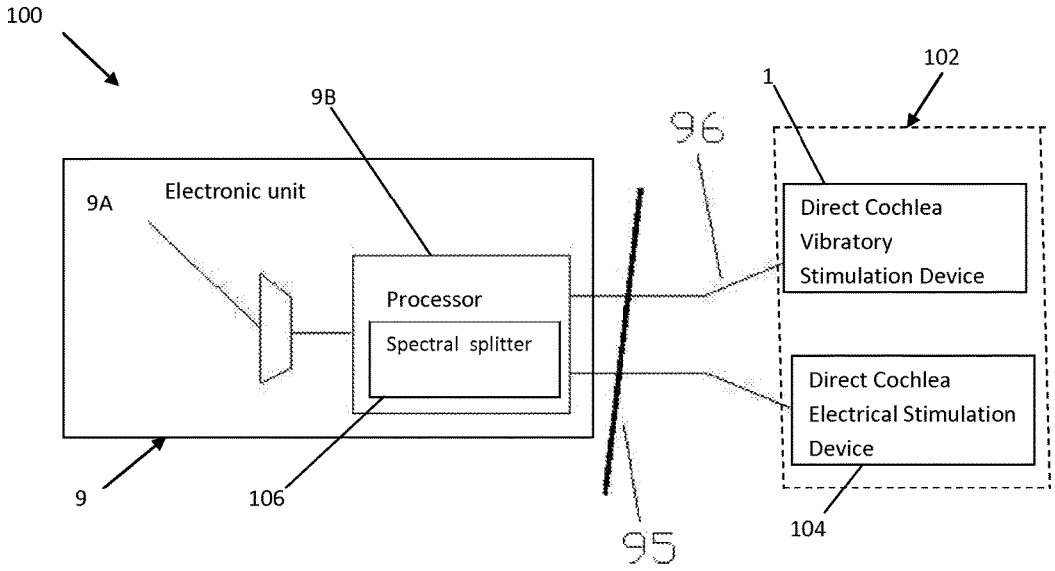
FIGS. 9A to 9C show three examples, respectively, of a hearing system utilizing the hearing aid device of the present invention.
Figure 9B:
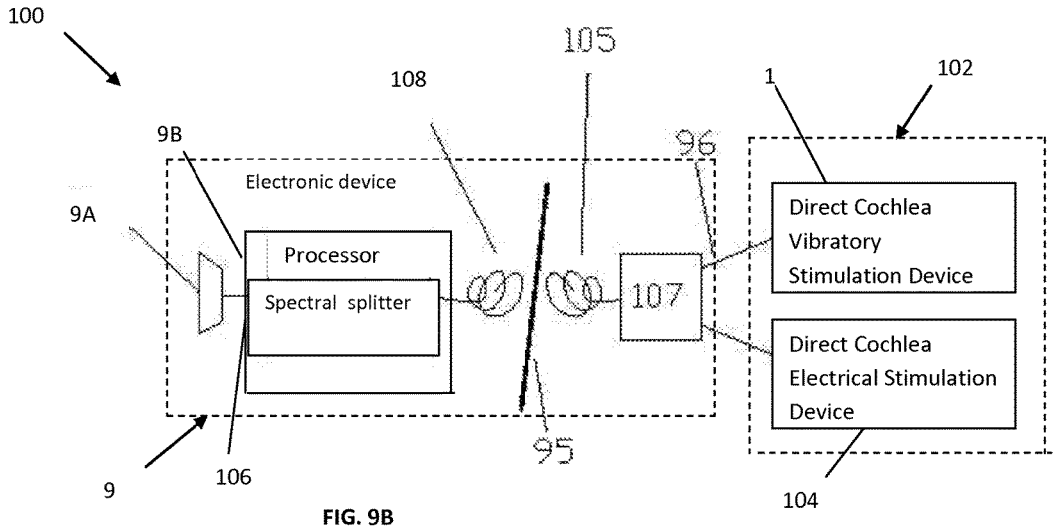
Figure 9C:
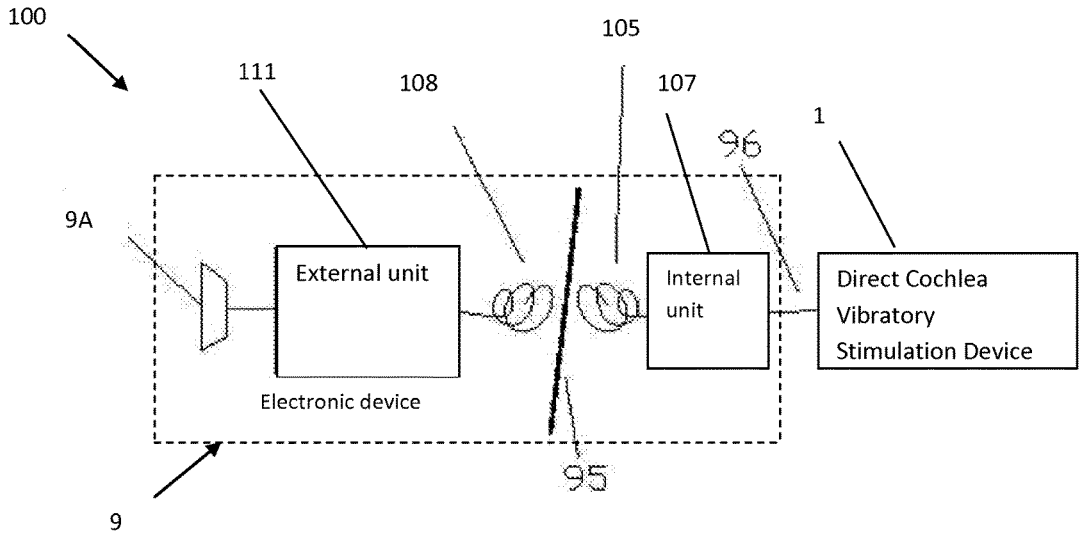

Reference is now made to FIGS. 9A to 9C showing by way of block diagrams, several examples of the operation of a system utilizing a cochlea stimulation device 102 and an electronic system 9.

In the examples of FIGS. 9A and 9B, the system 100 is designed for both direct cochlea vibratory stimulation and electrical cochlear stimulation for the hearing impaired. To this end, the stimulation device 102 includes the hearing aid device 1 of the present invention configured for direct cochlea vibratory stimulation, and a direct cochlea electrical stimulation device 104 that may include one or more implanted electrodes.

The electronic system 9 includes a microphone 9A, which preferably is to be placed in an ear canal thereby providing a user with spatial perception of the incoming sound source. The electronic system 9 also includes a signal processor 9B (configured as described above) which in this example includes a spectral (frequency) splitter utility 106 that may (or may not) be integrated with an amplifier. The spectral (frequency) splitter operates for spectrally splitting the received signal into two selected spectral ranges, which may be tunable as well as may be overlapping to a certain (e.g. tunable) degree. Signals of one spectral range are selected to meet the requirements of the direct cochlea vibratory stimulation device 1 for a specific patient, and the other spectral range is selected to meet the requirements of the direct cochlea electrical stimulation device (cochlear implant) 104 for said patient. In the example of FIG. 9A, the spectral splitter 106 may include an amplifier and its input and output are connected to respectively the output of the microphone and the stimulation devices 1 and 104 by wires 96 that may protrude through the bone next to an ear 95.

In the example of FIG. 9B, signal transfer between the modules/utilities of the electronic system 9 located in the outer ear and those in the middle and inner ear is performed in a wireless manner. The electronic system 9 includes a microphone 9A, preferably placed in the ear canal, which may be attached to an external (outside the body) signal splitter 106 (possibly utilizing or being a part of the amplifier 9B) which separates the sound signal into two spectral ranges selected as described above and which includes an appropriate wireless transmission utility (e.g. RF transmission). The external spectral splitter 106 may also be configured for encoding the RF signals in both spectral ranges. The electronic system 106 is associated (communicates) with external antennas which communicate one with another and further antenna 105 that communicates with an internal unit 107 (located in the middle ear) that receives the RF signal and directs portions thereof of the different spectral ranges, by wires 96, to the respective stimulation devices 1 and 104. The electric power supply to the internal unit 107 can be provided by batteries or by wireless energy transfer techniques as known in the art. The power transmitting and receiving circuits may be integrated into one or both of the external unit 106 and internal unit 107 or may be associated with a separate device.

FIG. 9C shows a system 100 configured for direct cochlea vibratory stimulation. The system 100 includes a hearing aid device 1 of the present invention and an electronic system 9, where the latter is configured generally similar to the above-described system of FIG. 9B, namely in which the connection between the modules/utilities of the electronic system located in the outer ear and middle ear is performed in a wireless manner. The microphone 9A is preferably placed in the ear canal, and is attached to an external unit 111 of the electronic system 9 which may include an amplifier and/or may be configured for modulating the parameters (e.g. frequency) of the microphone signal to meet the requirements of the direct cochlea vibratory stimulation device 1 for a specific patient. Also, the external unit 111 is configured for wireless (e.g. RF) communication with the microphone and an external antenna 108, and accordingly includes appropriate signal formatting utility). The external antenna 108 in turn communicates with an internal antenna (receiver) 105 for communicating the RF presentation of the microphone output to an internal unit 107 that receives the RF signal and creates a corresponding electrical signal to be fed by wires 96 into the stimulation device 1 for actuating deformation of the piezoelectric deformable member (e.g. stack) as described above. Similarly to the above-described example, the internal unit 107 may include batteries or may be configured for wireless energy transfer from the surroundings/external devices. The power transmitting and receiving circuits may be integrated in one or both of the external unit 111 and internal unit 107 and/or in a separate device and the same antennae may be used for transmitting power into the inner ear parts.

It should be understood, although not specifically illustrated that the device of FIG. 9C can be easily modified to utilize wire-based signal transmission. In this case, there is no need for antenna units.

The invention claimed is:

1. A hearing aid device, comprising:

a deformable member extending between first and second opposite sides thereof and configured for contracting and expanding along a deformation axis passing through the first and second opposite sides thereof with a deformation profile in response to an applied external field profile; and a fastening assembly comprising first and second fasteners defining first and second ends of the fastening assembly spaced from another along the deformation axis of the deformable member and rigidly connected to, respectively, said first and second sides of the deformable member, wherein the first fastener associated with the first side of the deformable member comprises an anchoring unit configured for rigid attachment to a first portion of a surface of bony tissue of a cochlea, and the second fastener associated with the second opposite side of the deformable member is configured for direct coupling to a second portion of a surface of bony tissue of the cochlear distant from the first portion along said deformation axis, so as to provide rigid coupling of the first and second sides of the deformable member to first and second distant portions of the surface of the bony tissue;

such that the deformation profile of the deformable member along the deformation axis between the first and second sides thereof during the contraction and expansion of said deformable member in response to the profile of the applied external field causes a corresponding movement of the first and second ends of the fastening assembly forcing movement of at least one of the first or second distant portions towards and away from the other portion resulting in direct transfer of the deformation profile of the deformable member to corresponding vibrations of the cochlea.

2. The hearing aid device according to claim 1, wherein the second fastener comprises a bio-compatible attachment material composition.

3. The hearing aid device according to claim 1, wherein the anchoring unit extends between two opposite ends thereof and is rigidly coupled by one of the opposite ends to the first side of the deformable member and has the other one of the opposite ends configured for rigid coupling to the first portion of the surface of the bony tissue of the cochlea; and the second fastener comprises a mating unit extending between two opposite sides thereof and being rigidly coupled by one of the opposite sides to the second side of the deformable member and having the other of the opposite sides configured for said direct coupling to the second portion of the surface of the cochlea by a bio-compatible attachment.

4. The hearing aid device according to claim 1, wherein the fastening assembly has one of the following configurations:

(i) an end of the anchoring unit is configured for rigid coupling to said first portion of the bony tissue, said first portion being a portion of an attic bone;

(ii) the end of the anchoring unit is configured for coupling to the first portion of the bony tissue, the first portion being a portion of a bone in the skull;

(iii) the end of the anchoring unit is configured for coupling to a promontorium portion of the cochlea; or (iv) the end of the anchoring unit is configured for coupling to a portion of an inner ear capsule.

5. The hearing aid device according to claim 1, wherein the deformable member comprises a piezoelectric structure responding to an applied field.

6. The hearing aid device according to claim 1, further comprising an electronic system for receiving sound pressure waves and transmitting corresponding actuating signals to the deformable member to thereby cause a deformation profile of the deformable member indicative of the received sound pressure waves.

7. The hearing aid device according to claim 6, wherein the electronic system is configured and operable for adjusting one or more parameters of the actuating signals according to predetermined requirements for a specific individual.

8. The hearing aid device according to claim 6, wherein the electronic system comprises a microphone for receiving sound pressure waves and generating electric output indicative thereof, and a signal processor configured for amplifying an actuating signal and providing a desired spectral profile of the actuating signal.

9. The hearing aid device according to claim 6, wherein the electronic system comprises a microphone configured to be placed in an ear canal of an individual and to be connectable to at least some other parts of the electronic system configured for location inside middle ear of said individual.

10. The hearing aid device according to claim 1, further comprising an additional hearing aid configured for direct cochlea electric stimulation.

11. The hearing aid device according to claim 10, further comprising an electronic system for receiving sound pressure waves and transmitting corresponding actuating signals to the deformable member to thereby cause a deformation profile of the deformable member indicative of the received sound pressure waves, the electronic system comprising a spectral splitter for generating the actuating signals in the form of two separate portions of different frequency ranges to be supplied to the two hearing aid devices.

* * * * *